United States Patent [19]

Karpiloff et al.

[11] Patent Number: 4,582,194

[45] Date of Patent: Apr. 15, 1986

[54] NESTED PACKAGING

[75] Inventors: Kenneth M. Karpiloff, New Rochelle; Douglas G. Rix, Jefferson Valley, both of N.Y.

[73] Assignee: Duracell Inc., Bethel, Conn.

[21] Appl. No.: 691,779

[22] Filed: Jan. 16, 1985

[51] Int. Cl.[4] ..... B65D 5/50

[52] U.S. Cl. ..... 206/44 R; 206/45.14; 206/45.19; 206/425; 206/485; 206/499

[58] Field of Search ..... 206/44 R, 45.14, 499, 206/45.19, 485, 526, 425

[56] References Cited

U.S. PATENT DOCUMENTS 3,187,889 6/1965 Sinclair ..... 206/499

3,927,761 12/1975 Boyle ..... 206/45.14

*Primary Examiner*—William T. Dixson, Jr.

*Assistant Examiner*—Brenda J. Ehrhardt

*Attorney, Agent, or Firm*—Ronald S. Cornell; Israel Nissenbaum

[57] ABSTRACT

A packaging method and a package for bulk containment of lop-sided articles such as blister carded or similarly packaged items in a space saving nested arrangement are described. A tray, such as a display tray, containing the blister carded items, has retaining means such as a tray wrapper to prevent unintended spillage of the blister carded items but which permits nesting of the blister cards contained within two closely juxtaposed trays whereby efficient nesting of the packed items is obtained in a readily handled package having structurally retentive properties.

19 Claims, 7 Drawing Figures

NESTED PACKAGING

This invention relates to bulk packaging of irregularly but nestably shaped articles such as packaged items having package extensions. This invention particularly relates to packaging of blister carded items in display trays.

Irregularly shaped articles and more particularly irregularly shaped packaged items (wherein the packaging has an extension section such as for product information text) provide problems in bulk shipping, storage and handling. Packages such as blister cards (a cardboard card attached to a plastic blister into which a product is placed) with text information headers are generally lop-sided (wide at one end and narrow at the other) and exemplify such irregularly shaped articles. Blister card packages are generally configured with the bulk or wide part (with the product) at one end of the card. The other end of the card is generally a narrow part comprising a simple cardboard extension (header) for text information. As a result of such lop-sided configuration such blister card packaged products are difficult to pack efficiently for bulk shipment. In addition, the card headers are relatively fragile and are susceptible to shipping damage. Bulk packaging is thus further rendered less efficient in order to provide means for prevention of such damage. In the past, such blister card packaged products have been bulk shipped in containers with a staggered reverse orientation of the blister cards (i.e. "nesting"—juxtaposition of the narrow part of one package with the wide part of another) in order to minimize shipping space. However, when such containers are opened, after shipment or storage, the blister cards must be individually manually removed and placed within display trays or on display racks. In order to avoid such costly manual handling, blister card packaged items have been shipped in display trays but at the expense of using costly filler materials to protect the header cards and of course considerable wasted shipping space. Nesting of the blister card packages while contained within display trays, in order to minimize shipping and storage space, generally results in the blister card packages spilling from the trays, upon separation of the trays. Thus, manual handling is again necessitated. At present, articles and containers are being configured specifically for nesting with each other but again such nested arrangement, while space saving, requires manual handling for display purposes.

It is an object of the present invention to provide an inexpensive but efficient packaging and packaging method for bulk packaging of irregularly but nestably shaped articles, such as blister cards, in containers such as display trays with the advantages of reduced shipping space, reduced article damage and ease of handling with substantial elimination of manual handling.

This and other objects, features and advantages of the present invention will become more evident from the following discussion and drawings in which.

Figure 1:
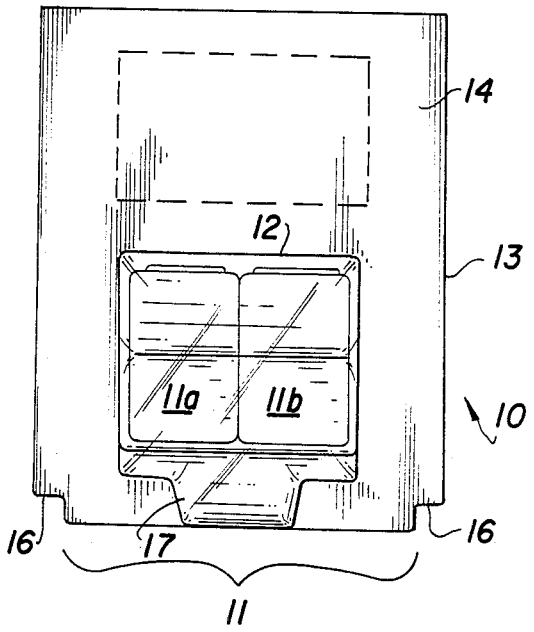
FIG. 1 is a front view of a blister card package containing batteries.

Generally the present invention comprises a package and a packing or packaging method for bulk packing or packaging of nestable irregularly shaped articles such as blister card packages. As used herein the term "nesting" refers to the physical juxtaposition of irregularly shaped or lop-sided articles in a manner to reduce the packing volume occupied by such articles. Thus, for example, a blister card having broad and narrow portions can be nested with a second substantially identical blister card by juxtaposing the broad and narrow portions of the first blister card with the narrow and broad portions of the second blister card respectively. The packing volume of both cards is thereby efficiently reduced.

The packaging method of the present invention comprises supportively placing at least two irregularly but nestably shaped articles against a first supporting member, such as a tray, in a sequential ordered arrangement or orientation, generally standing, suitable for subsequent nesting of such articles with articles supported by a second supporting member. Once the articles are in place they are physically retained against movement away from the supporting member. Thereafter, articles retained by two or more of said supporting members are nested with each other with the supporting members thereby being brought into close physical proximity or juxtaposition with each other. The juxtaposed supporting members are then secured and prevented from becoming inadvertantly separated. A compact, space efficient article-retentive package of said irregularly shaped but nestable articles is thereby formed.

In accordance with the present invention, the articles are physically retained, against movement away from the supporting member, with sufficient retaining strength to prevent such unintended movement of the articles when the juxtaposed supporting members are separated from each other. Thereafter, upon intentional separation, the articles are released or are rendered releasable from the supporting members for individual removal of the articles, such as for a consumer purchase, without the necessity for manual manipulation of the articles.

The bulk article package of the present invention comprises:

(a) first and second members with each supporting a plurality of nestable irregularly shaped articles in an ordered arrangement or orientation suitable for subsequent nesting with articles supported by the other of said supporting members;

(b) means for retaining the articles against each of said supporting members respectively. The article retaining means must have sufficient retaining strength to prevent movement of the articles from the supporting member upon separation of the juxtaposed supporting members from each other. In addition the article retaining means should not prevent or substantially impede the nesting of the articles; and (c) means for preventing inadvertant separation of said juxtaposed supporting members from each other.

In a preferred embodiment of the present invention each of said article supporting members comprises a tray for the support and generally also containment of lop-sided articles such as blister cards. In such embodiment the article retention means preferably comprises tray wrappers which fixedly retain the articles against or within each of such trays. Apertures in a portion of the tray wrapper permit outward extension of the blister card headers of the blister card packages contained within the tray and the insertion of blister card headers (of blister card packages contained within another tray) to effect the requisite nesting. Thus, for example, with the close juxtaposition of two wrapped trays the header sections of the blister cards contained in each tray extend into the opposing tray and between the blister cards contained therein to form a space-efficient nesting arrangement. The blister card header at the end of each tray is usually not inserted between blister cards contained within the second tray but is rather nestingly abutted against an end blister card package in the second tray and the end wall of the tray. With the tray wrapper, which functions to retain the articles in the trays, such nesting operation is easily effected without accidental spillage of the contained blister card packages.

In accordance with a further preferred embodiment of the present invention, the trays also serve as the display carrier for the products for consumer purchase. In such embodiment the blister carded items are snugly positioned in the trays in the manner they are to be eventually displayed. Such positioning results in the card portion of the blister package, generally with product text material thereon, extending upwardly for consumer notice. Article package retention means, such as the previously referred to wrappers, retain the carded items within the tray with such means permitting nesting of the trays whereby the exposed cards of items in one tray are inserted into spaces between the carded items of the other tray. Preferably, such article retention means are removable prior to utilization of the tray as an article display tray with the articles thereby being freely removable by consumers for purchase without disruption of the tray or the other articles. Alternatively, article package retention means may be embodied in the display tray but with controlled holding power i.e. sufficient to hold the articles during separation of the nested trays but not sufficient to prevent removal of an article by a consumer for purchase. In a further embodiment the article retention means may be removed with the purchase of individual articles.

After the nesting of the articles, with close juxtaposition of the trays, inadvertant separation of the trays during subsequent handling involving storage, shipment and the like is prevented by separation prevention means. After such storage or shipment, when the articles are to be displayed to consumers, the separation prevention means is removed or rendered inoperative. Thereafter, the trays with contained articles are separated, with the article retention means preventing inadvertant spillage of the articles from the trays. The article retention means is then removed if it is of the removable type (e.g. apertured wrappers) or otherwise rendered inoperative and each tray, with contained articles, is placed on display.

In further preferred embodiments of the present invention the article retention means comprises apertured wrappers which are wrapped around the top and sides of each of the display trays and with each being either attached to itself by means such as an adhesive, an adhesive tape or the like (with a full wrapping of the display tray) or attached to the sides or bottom of the tray such as with an adhesive material which permits separation of the wrapper from the display tray without aesthetic damage thereto. The wrapper is preferably a precut cardboard member. Alternatively, such wrapper can be comprised of a flexible plastic wrap or other material which provides the requisite retention.

The article retention means must permit nesting of the articles. With the preferred wrapper it may be apertured initially to permit extension and insertion of the blister card headers, as described, for nesting. Alternatively, the nesting process itself may be devised to provide such apertures upon the nesting engagement of the articles.

In order to aid in insertion of the articles between opposing articles and nesting thereof it is preferred that means for facilitating such insertion be provided either by the articles, by the retaining trays or by the retention means itself. A preferred example of such means for aiding insertion comprises a ramping of the blister package to guide the insertion by providing a clearance between adjacent articles. Simple extensions of the package such as blisters on the blister packaging may be similarly utilized.

Figure 2:
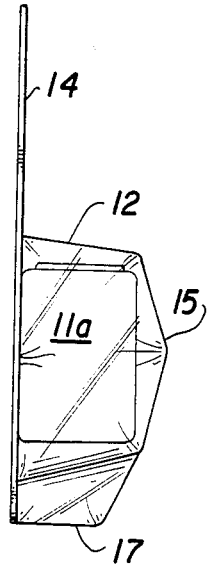
FIG. 2 is a side view of the blister card package, with batteries, of FIG. 1.
Figure 3:
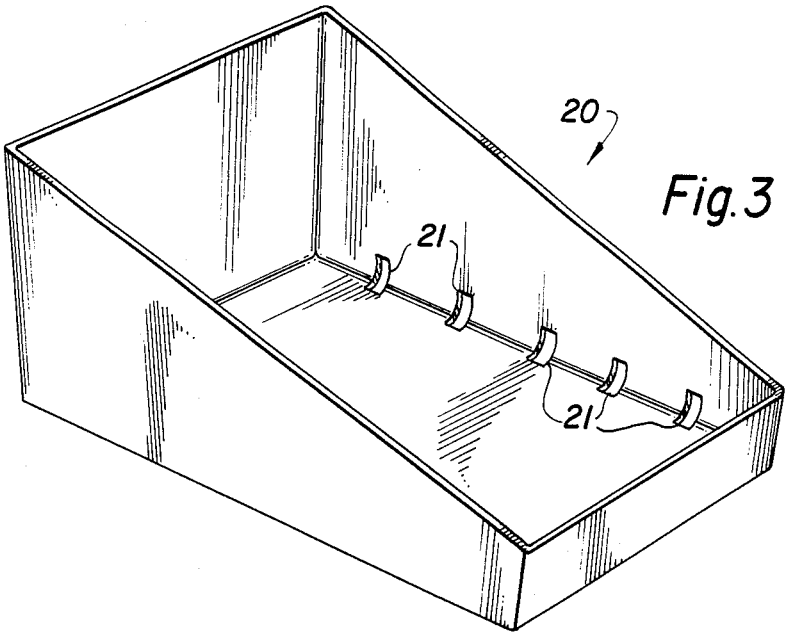
FIG. 3 is an isometric view of a display tray for holding blister card packages such as shown in FIGS. 1 and 2.

With specific reference to the drawings, FIG. 1 depicts a typical blister package 10 for the display merchandising of batteries 11*a* and 11*b*. Said batteries are contained within plastic (usually of a polyvinylchloride-PVC material) blister 12 which is attached to card 13. Cutouts 16 at the corners of the base of card 13 eliminate loss of aesthetic appeal of the card by damage to such corners during subsequent bulk packaging of the blister packages 10 in display trays. The plastic blister 12 includes ramped section 15 and a pedestal type base 17 integrally formed therewith. The header area 14 of the card above the packaged batteries generally contains informational text material such as product trademarks, generic name, price etc. However, as more clearly illustrated in FIG. 2, the utilization of such information header results in a lopsided package with the bulk thereof at the product side. Such products are generally contained within a display tray 20 such as shown in FIG. 3 whereby the blister carded products are sequentially displayed for catching consumers' eyes. In order to prevent toppling of the carded items in the tray, upon the sequential removal of such articles from the tray, cutouts 21 serve to hold the carded items erect particularly when the articles have the pedestal base 17 shown in FIGS. 1 and 2.

Figure 4:
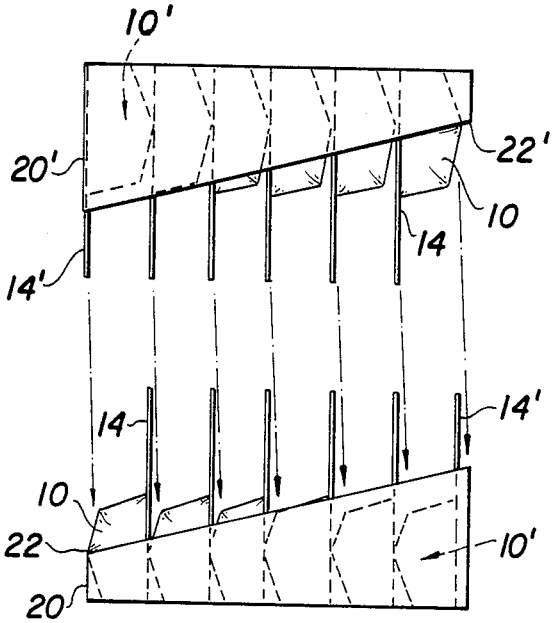
FIG. 4 is a side view of two display trays, containing blister card packages, with batteries, such as shown in FIGS. 1 and 2, being nested with one another.

As shown in FIG. 4, the blister card packages 10 are sequentially placed within display tray 20 with the headers 14 thereof extending upwardly away from the display tray 20. A second display tray 20' containing blister card packages 10 is shown in a nesting position (open end 22' facing open end 22 of tray 20 and rotated by 180°) relative to first tray 20 whereby the header sections 14 of the blister cards of each of the battery packages is inserted between the battery packages contained in the opposing tray as indicated by the dashed arrows. End battery packages 10', in each of trays 20 and 20', have headers 14' which provide end walls for the nested trays 20' and 20 respectively.

In the arrangement shown in FIG. 4, separation of the display trays 20 and 20' generally results in the spillage of at least some of the carded battery packages from the trays thereby necessitating manual reinsertion. Additionally, the nesting itself is difficult because of the relative free movement of the blister card packages in each of the trays.

Figure 5:
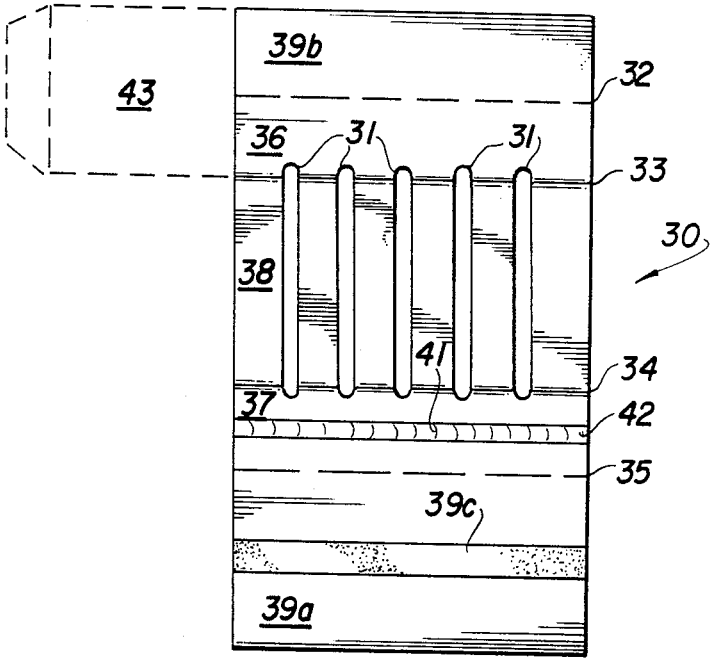
FIG. 5 is an unfolded view of the article retaining member of the present invention.

In accordance with the present invention an article retention means is used such as wrapper 30 shown in FIG. 5 which is deployed around each of the display trays with contained articles to provide a structurally retentive package. The wrapper 30 contains apertures 31 to permit insertion therethrough of the header cards 14 of the blister card packages 10. Each of such apertures is of sufficient width to permit extension of the headers of the blister card packages contained in the tray to which it is attached and insertion of the adjacent opposing blister card package headers contained within the other opposing tray. Crease lines 32–35 indicate the points at which the wrapper is folded to enclose a display tray with sections 36 and 37 forming the sides of the wrapper and sections 38, 39*a* and 39*b* forming the upper and lower portions of the wrapper (sections 39*a* and 39*b* are glued together with adhesive 39*c* to form bottom section 39 of the wrapper shown in FIG. 6). In order to facilitate utilization of the wrapper 30 the apertures 31 extend the entire width of the top of the wrapper and over a portion of the top of sides 36 and 37. The extended apertures additionally reduce the possibility of header card damage upon deployment of the wrapper 30. Zipper 41 with pull tab 42 facilitates removal of wrapper 30 when the display trays are to placed for consumer attention and purchase. Until such time the blister carded batteries are fixedly retained within the trays as shown in FIG. 6 and are prevented from spilling therefrom even upon separation of the nested trays shown in FIG. 7.

Figure 6:
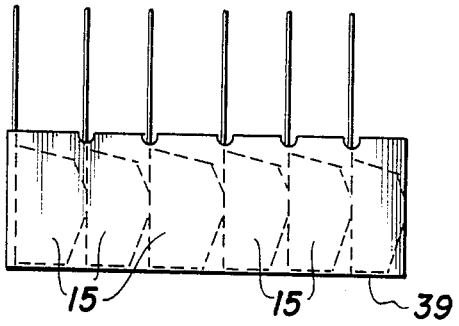
FIG. 6 is a view similar to FIG. 4 of two display trays but with the article retaining member of FIG. 5 being utilized.

As seen in somewhat exaggerated form (for clarity) in FIG. 6 the individual blister packages 10 are slightly spaced from each other by ramp sections 15. This spacing facilitates insertion of the header portions of blister packages in the other nesting tray between adjacent blister packages. In addition, the ramping guides such insertion as well. For aesthetic purposes the ramp should be as imperceptible as possible but with the ability to perform such intended function.

Figure 7:
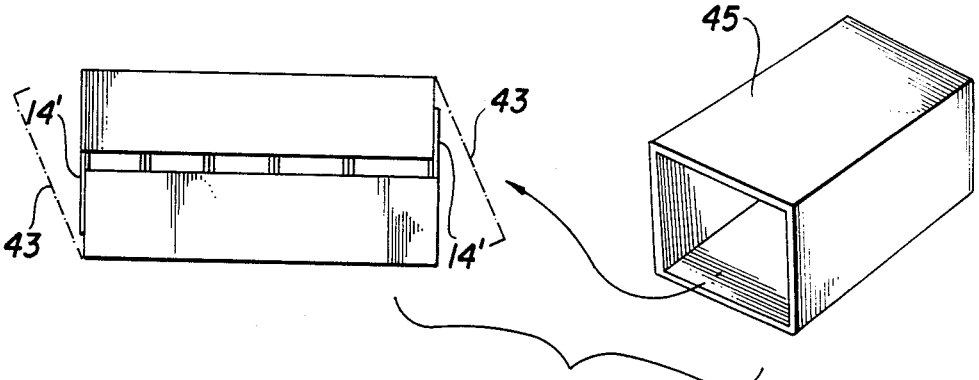
FIG. 7 is a side view of the nested trays of the present invention prior to final sleeving or packaging.

When the trays with contained blister carded batteries are fully nested, as shown in FIG. 7, the header 14' of the end blister card of each of the trays may either be inserted in the opposing tray or may be positioned outside the opposing tray since in such end position it is not as subject to damage. If desired, wrapper 30 may embody a tuck tab 43 shown in dotted lines which, in the completed nested tray package, serves to close the ends of such nested package and hold the trays together. Alternatively, the nested package may be enclosed by either an open or closed ended sleeve 45 or box to prevent such nested tray separation.

It is understood that the above specific description of the drawings and the packaging arrangement of the present invention is illustrative of the present invention and that changes may be made without departing from the scope of the present invention as defined in the following claims.

What is claimed is:

1. A package for containment of a plurality of irregularly shaped, nestable articles comprising first and second trays which are juxtaposed with each other, with each of said trays having an open end into which open end a plurality of nestable irregularly shaped articles are placed, with said articles being contained, in an ordered arrangement, within each of said trays, with the articles contained within one of said trays being nested with articles contained within the other of said trays, characterized in that said package further comprises:

(a) removable means for retaining each of said articles within the tray in which it is contained; and (b) means for holding said trays in juxtaposition with each other;

wherein said removable article retaining means provides sufficient retaining strength to prevent movement of the articles out of the open end of the tray, containing said articles, upon separation of the juxtaposed trays from each other, with said removable retaining means being adapted to be removed from said trays whereby articles contained within each of said trays may be removed through the open ends thereof respectively, and wherein said removable article retaining means do not substantially impede said nesting of the articles.

2. The package of claim 1 wherein said articles comprise blister card packages with each comprising a cardboard card attached to a plastic blister thereby forming an enclosure into which a product is placed, with each of said blister card packages being configured such that the blister, with contained product, is located at one end of the card, with said end of the card being seated in one of said trays, and wherein the other end of the card comprises a cardboard extension header, with said cardboard extension header extending out of the tray, containing said blister card package, into nesting engagement with a blister card package contained within the other of said trays.

3. The package of claim 2 wherein each of said trays comprises cutout portions therein into which said seated card end is placed and supportively held thereby.

4. The package of claim 2 wherein said removeable article retaining means comprises two apertured members individually affixed to each of said trays to substantially enclose and fixedly retain the blister card packages, contained within said trays respectively, within said trays respectively, and wherein each of said cardboard extension headers of the retained blister packages extends beyond the apertured member which retains said blister card packages.

5. The package of claim 4 wherein one of the cardboard extension headers, of the blister card packages enclosed within a first tray, extends beyond a periphery of the apertured retaining member affixed to said first tray and the remaining cardboard extension headers, of the blister card packages enclosed within said first tray, extend through apertures in said retaining member and wherein one of the cardboard extension headers, of the blister card packages contained within a second tray, extends beyond a periphery of the apertured retaining member affixed to said second tray and the remaining cardboard extension headers, of the blister card packages enclosed within said second tray, extend through apertures in said retaining member affixed to said second tray and wherein said remaining cardboard extension headers, of the blister card packages enclosed within said first tray, extend through apertures in the retaining member affixed to said second tray and the remaining cardboard extension headers, of the blister card packages enclosed within said second tray, extend through apertures in said retaining member affixed to said first tray.

6. The package of claim 4 wherein said apertured members comprise wrappers which are wrapped around each of said trays respectively with the ends of each of said wrappers respectively being adhered to each other to provide an enclosure having said sufficient retaining strength.

7. The package of claim 6 wherein said wrappers comprise zipper opening means for ready removal of said wrapper from the tray enclosed therewithin.

8. The package of claim 1 wherein said means for holding said trays in juxtaposition comprises a sleeve which encloses both of said supporting members with enclosed nested articles.

9. The package of claim 6 wherein said means for holding said trays in juxtaposition comprises a tuck tab extension member integrated with each of said wrappers such that each of said tuck tab extension members spans an open end of said juxtaposed individually wrapped trays with the end of each of said tuck tab extension members being tucked between the wrapper of the other of said trays and said other tray.

10. The package of claim 2 wherein said plastic blister includes means for facilitating said nesting.

11. The package of claim 10 wherein said means for facilitating said nesting comprises a ramping of said plastic blister such that close placement of said blister card packages in said ordered arrangement provides a space between adjacent blister card packages in said ordered arrangement for insertion of a cardboard header of another blister card package therebetween.

12. The package of claim 2 wherein the corners of said card end, seated in a tray, are cut out.

13. The package of claim 2 wherein a pedestal is integrated with said plastic blister whereby said blister card package is capable of standing without external support.

14. The blister card package of claim 2 wherein batteries are contained within said plastic blister.

15. A method of packaging nestable blister card packages having header portions comprising the steps of placing at least two of said blister card packages in a sequential ordered standing arrangement in a first tray, placing at least two of said blister card packages in a sequential ordered standing arrangement in a second tray, with said sequential ordered standing arrangement of said blister card packages in each of said trays being such that the header portion of each of the blister card packages in each of said trays extends out of the tray into which it is placed whereby such outwardly extending header portion nests with a blister card package placed within the other of said trays when said first and second trays are juxtaposed with one another, and nesting said blister card packages by juxtaposing said first and second trays, characterized in that said method comprises the steps of retaining said blister card packages against inadvertant removal from the trays into which they are placed, prior to said nesting, and securing said trays from inadvertant separation from each other, after said nesting and wherein said blister card packages are retained against inadvertant removal from the trays by two apertured members with each being affixed to one of said trays such that said blister card packages are enclosed thereby within the trays in which they are placed and wherein the apertures of said enclosing apertured member are aligned with the header portion of a plurality of blister card packages enclosed therewithin with said plurality of blister card package heder portions extending outwardly through said apertures.

16. The method of claim 15 wherein each apertured member is attached to itself to form a closed wrapper around said tray and wherein means are provided for removal thereof.

17. The method of claim 16 wherein said juxtaposed trays are secured from inadvertant separation by being placed within a sleeve which encloses said trays.

18. The method of claim 16 wherein said juxtaposed trays are secured from inadvertant separation by means of tuck tab extension members integrated with each of said wrappers such that each of said tuck tab extension members spans an open end of said juxtaposed individually wrapped trays with the end of the tuck tab extension member of the wrapper of one tray being tucked between the wrapper of the other of said trays and said other tray.

19. The method of claim 15 wherein batteries are contained by said blister card packages.

* * * * *